US007121172B1

(12) United States Patent
Daniels

(10) Patent No.: US 7,121,172 B1
(45) Date of Patent: Oct. 17, 2006

(54) DUAL-HEADED RATCHETING BASIN WRENCH

(76) Inventor: Joseph Daniels, 1478 72nd St., Brooklyn, NY (US) 11220

( * ) Notice: Subject to any disclaimer, the term of this patent is extended or adjusted under 35 U.S.C. 154(b) by 200 days.

(21) Appl. No.: 10/852,720

(22) Filed: May 24, 2004

(51) Int. Cl.
*B25B 13/28* (2006.01)
*B25B 23/16* (2006.01)

(52) U.S. Cl. ..... 81/98; 81/57.3; 81/177.2

(58) Field of Classification Search ..... 81/98, 81/DIG. 8, 57.3, 180.1, 177.2
See application file for complete search history.

(56) References Cited

U.S. PATENT DOCUMENTS

| | | | | | |
|---|---|---|---|---|---|
| 614,255 | A | * | 11/1898 | McChesny | 81/98 |
| 785,930 | A | * | 3/1905 | Anderson | 81/DIG. 8 |
| 1,485,062 | A | | 2/1924 | Baldus | |
| 1,708,147 | A | | 4/1929 | Miller | |
| 1,914,827 | A | | 6/1933 | Hammerich | |
| 2,607,248 | A | | 8/1952 | Vlasak et al. | |
| 2,787,180 | A | | 4/1957 | Fish | |
| 2,909,089 | A | | 10/1959 | Thompson et al. | |
| 2,990,213 | A | | 6/1961 | Kolacinski | |
| 3,889,558 | A | | 6/1975 | Duncan | |
| 4,485,702 | A | * | 12/1984 | Swan et al. | 81/98 |
| 4,504,087 | A | | 3/1985 | Pennington | |
| 4,509,784 | A | | 4/1985 | Vollers | |
| 4,622,869 | A | | 11/1986 | Lee | |
| 4,680,994 | A | | 7/1987 | Singleton | |
| 4,749,251 | A | | 6/1988 | Moulin | |
| 4,907,476 | A | | 3/1990 | Singleton | |
| 5,251,519 | A | * | 10/1993 | Lang | 81/177.2 |
| 5,279,190 | A | | 1/1994 | Goss et al. | |
| 5,531,141 | A | | 7/1996 | Gilbert, Jr. | |
| 5,775,183 | A | | 7/1998 | Tavianini | |
| 6,330,840 | B1 | | 12/2001 | McCormick et al. | |

* cited by examiner

*Primary Examiner*—Hadi Shakeri
(74) *Attorney, Agent, or Firm*—Michael I Kroll

(57) ABSTRACT

A dual-headed ratchet basin wrench for use with compression fittings having a lock nut affixed to a coupling wherein a pair of ratchet jaws rotate to turn the lock nut while a pair of stationary jaws serve to retain the coupling in position thereby overcoming the shortcomings of prior basin wrenches which would turn not only the desired lock nut but also inadvertently turn the coupling and loosen the connection on the other side thereby requiring the user to utilize a second tool to prevent the subjacent nut from turning.

9 Claims, 9 Drawing Sheets

DUAL-HEADED RATCHETING BASIN WRENCH

BACKGROUND OF THE INVENTION

1. Field of the Invention

The present invention relates generally to plumbing and, more specifically, to a dual-headed basin wrench that maintains the nut of a main water supply in a stationary position while turning the nut of a supply line leading to a faucet.

Space is very limited under sinks due to an enclosed area having a plurality of supply lines, a drain assembly and other such obstacles thus making simple chores like disconnecting a supply line difficult with wrenches that are turned perpendicular to the fitting. Removing an old faucet and installing a new one is next to impossible with out a basin wrench (also referred to as a faucet wrench). In order to remove/install a faucet on a working sink it's necessary to loosen/tighten locknuts that are located underneath and behind the sink bowl. Not only is it necessary to twist your body into a small space, you are laying on your back and there's only about three inches of working space around these locking nuts. A basin wrench is a plumbing tool for removing and installing sink faucets and is often used in such instances. A basin wrench has a long handle that reaches up from under a sink to turn nuts on fittings and faucets. A basin wrench is normally used to loosen or tighten locknuts for supply hoses attached to compression fittings. Unfortunately, the pressure applied to the locknut often loosens the connection of the coupling on the main water supply side which often requires the use of a second tool to maintain the coupling in a fixed position as the locknut is being turned. This is quite undesirable considering the already cramped worked space and awkward positioning. The present invention seeks to overcome the shortcomings of the prior art by introducing a dual-headed basin wrench that will have a ratcheting head that will turn the locknut and a stationary head that will secure the coupling in a fixed position when pressure is applied to the connected locknut being turned.

2. Description of the Prior Art

There are other remote wrench devices designed for plumbing systems. Typical of these is U.S. Pat. No. 41,485,062 issued to Baldus on Feb. 26, 1924.

Another patent was issued to Miller on Jan. 24, 1927 as U.S. Pat. No. 1,708,147. Yet another U.S. Pat. No. 1,914,827 was issued to Hammerich on May 1, 1931 and still yet another was issued on Apr. 2, 1957 Fish as U.S. Pat. No. 2,787,180 and still yet another was issued on Oct. 20, 1959 to Thompson et al. as U.S. Pat. No. 2,909,089.

Another patent was issued to Duncan on Jun. 17, 1975 as U.S. Pat. No. 3,889,558. Yet another U.S. Pat. No. 4,622,869 was issued to Lee on Nov. 18 1986. Another was issued to Singleton on Jul. 21, 1987 as U.S. Pat. No. 4,680,994 and still yet another was issued on Mar. 13, 1990 to Singleton as U.S. Pat. No. 4,907,476.

A patent was issued to Tavianini on Jul. 7, 1998 as U.S. Pat. No. 5,775,183. McCormick et al. were issued U.S. Pat. No. 6,330,840 on Dec. 18, 2001.

While these ratchet devices may be suitable for the purposes for which they were designed, they would not be as suitable for the purposes of the present invention, as hereinafter described.

SUMMARY OF THE PRESENT INVENTION

A primary object of the present invention is to provide a dual-headed basin wrench that will turn a lock nut on a compression fitting while holding the coupling immediately subjacent thereto to prevent it from turning.

Another object of the present invention is to provide a dual-headed basin wrench that utilizes a ratchet assembly to rotate a ratcheting head around the lock nut to be turned.

Yet another object of the present invention is to provide a dual-headed ratcheting basin wrench having a stationary jaw assembly having a ratchet drive recess through which the ratchet drive passed through and rotates freely therein to maintain the position of said jaw assembly on the coupling while the ratcheting jaw assembly is turning the lock nut Still yet another object of the present invention is to provide a dual-headed ratcheting basin wrench having a selectively extendible handle.

Another object of the present invention is to provide a dual-headed ratcheting basin wrench that is simple and easy to use.

Yet another object of the present invention is to provide a dual-headed ratcheting basin wrench that is inexpensive to manufacture and operate.

Additional objects of the present invention will appear as the description proceeds.

The present invention seeks to overcome the shortcomings of the prior art by introducing a dual-headed basin wrench that will have a ratcheting head that will turn the locknut and a stationary head that will secure the coupling in a fixed position when pressure is applied to the connected locknut being turned.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
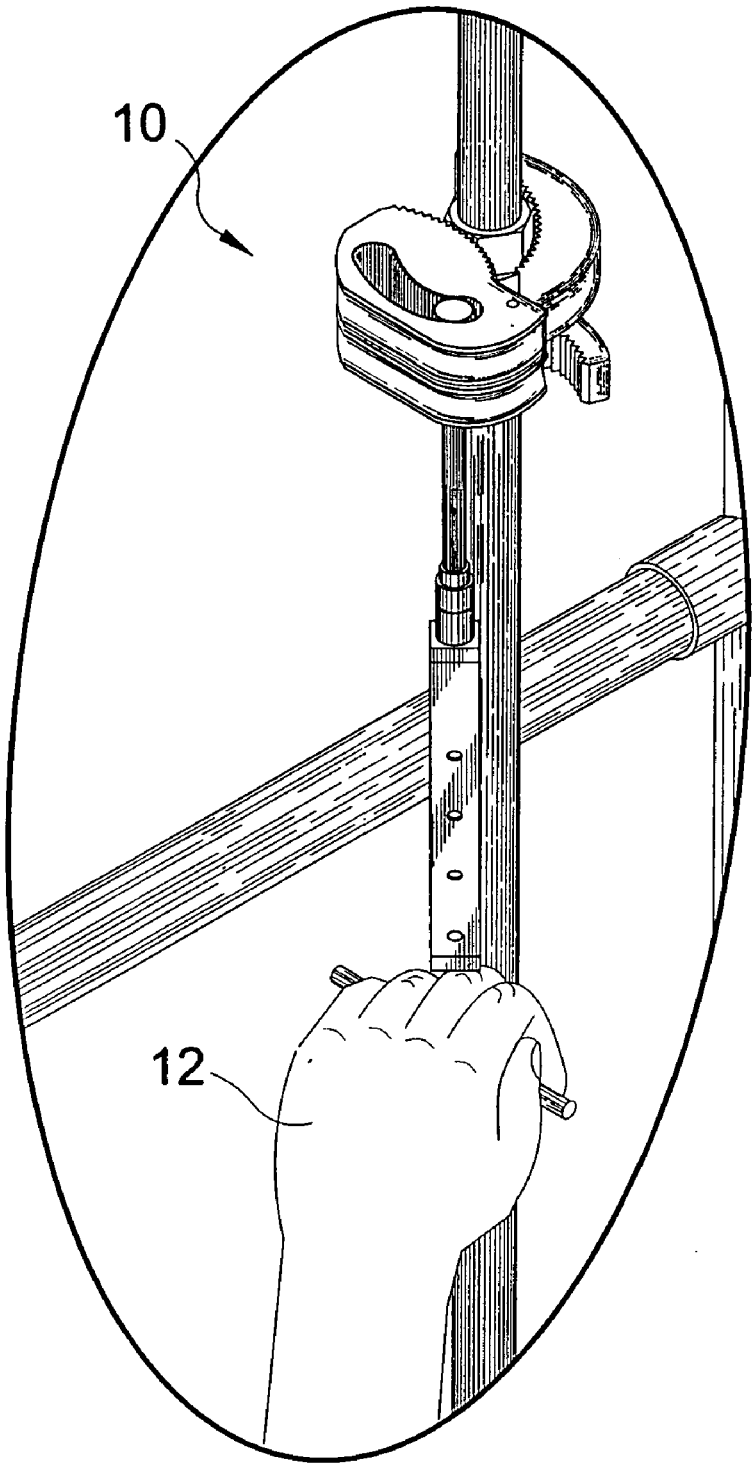
FIG. 1 is an illustrative view of the present invention in use.

Turning now descriptively to the drawings, in which similar reference characters denote similar elements throughout the several views, the figures illustrate the Dual-Headed Ratcheting Basin Wrench of the present invention. With regard to the reference numerals used, the following numbering is used throughout the various drawing figures.

10 Dual-Headed Ratcheting Basin Wrench
12 user
14 upper ratcheting jaw assembly
16 lower stationary jaw assembly
18 handle
20 ratchet assembly
22 ratchet drive
24 T-handle
26 slide stopper
28 base jaw of 14
30 clamping jaw of 14
32 hinge pin
34 tension spring
36 ratchet drive input groove
38 serrations
40 base jaw of 16
41 clamping jaw of 16
42 ratchet drive input aperture
44 nut
46 coupling
48 handle barrel
50 spline shaft
52 detent
54 detent spring
56 throughbore of 50
58 locking throughbores of 48

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention 10 is a tool for compression fittings comprised of three major assemblies. The racheting jaw assembly tightens or loosens the locking nut to the coupling. The stationary jaw assembly constrains the tool to the compression fitting coupling. The extendible spline handle assembly maintains the proper alignment of the jaw assemblies and is turned by the user 12 to operate the tool. The upper ratcheting jaw is frictionally fitted and can be flipped in the opposite direction.

Figure 2:
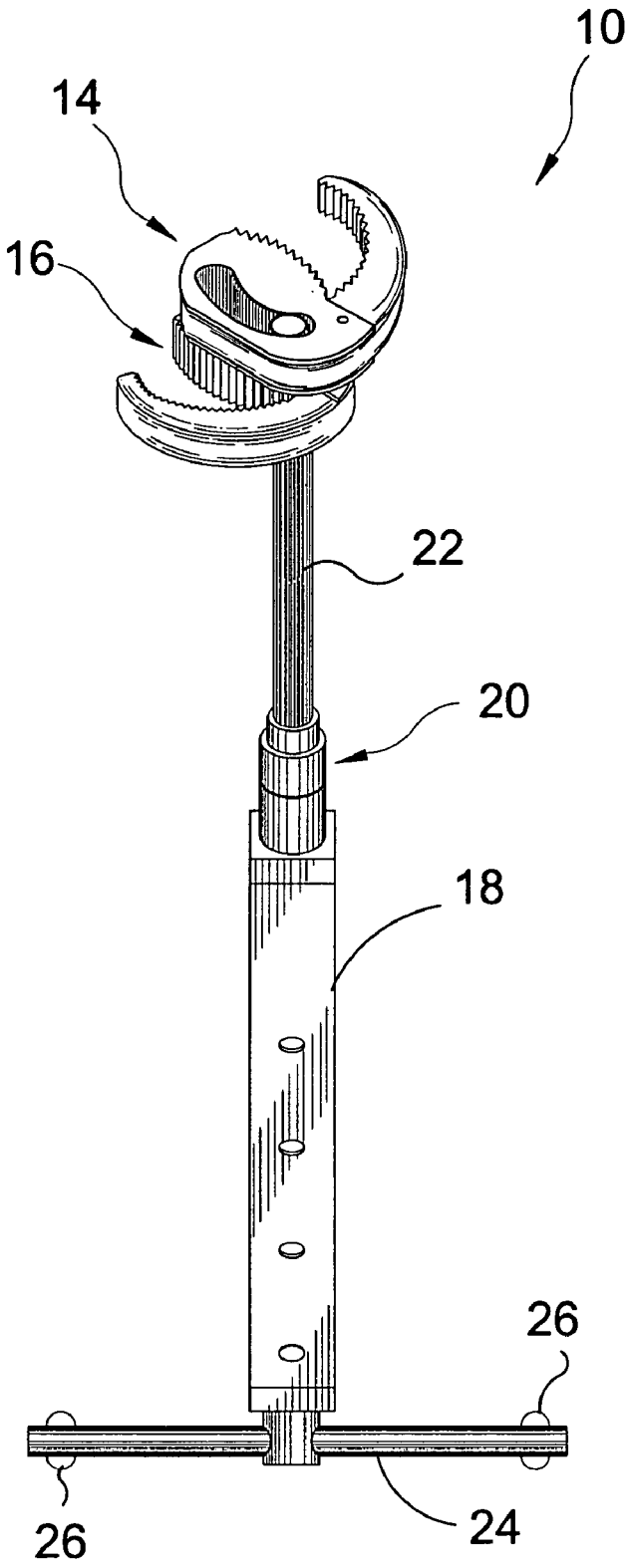
FIG. 2 is a perspective view of the present invention.

FIG. 2 is a perspective view of the present invention 10. The present invention 10 comprises a handle 18 with an integral ratchet assembly 20 having a ratchet drive 22 extending therefrom. A slidable T-handle 24 with slide stoppers 26 disposed on the end of handle 18. The stationary jaw assembly 16 and the ratcheting jaw assembly 14 are disposed on the distal end of the ratchet drive 22.

Figure 3:
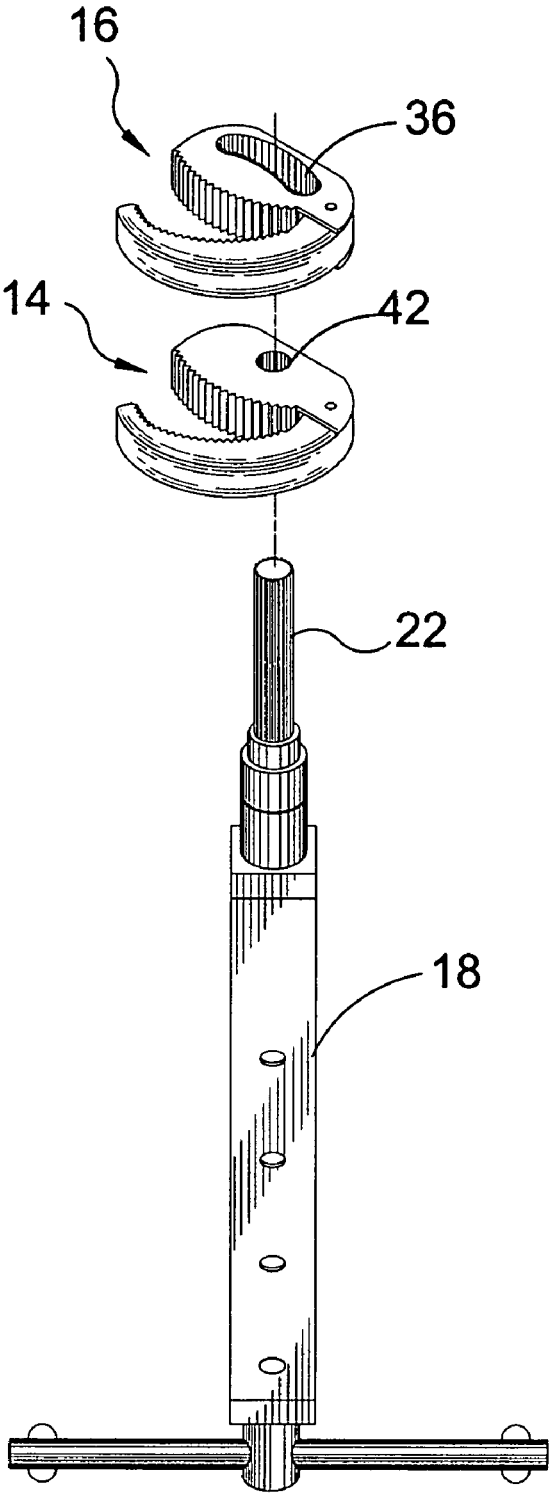
FIG. 3 is a perspective view of the present invention.

FIG. 3 is an exploded view of the upper ratchet assembly 14 and lower ratchet assembly 16 of the present invention 10, a tool for compression fittings comprised of three major assemblies. The ratcheting jaw assembly 14 tightens or loosens the coupling. The stationary jaw assembly 16 constrains the tool to the compression fitting coupling. The extendable spline handle assembly 18 maintains the proper alignment of the jaw assemblies and is used to operate the tool. The ratchet drive 22 is inserted through the ratchet drive input aperture 42 of the stationary jaw assembly 16 and the ratchet drive input slot 36 of the ratcheting jaw assembly 14.

Figure 4:
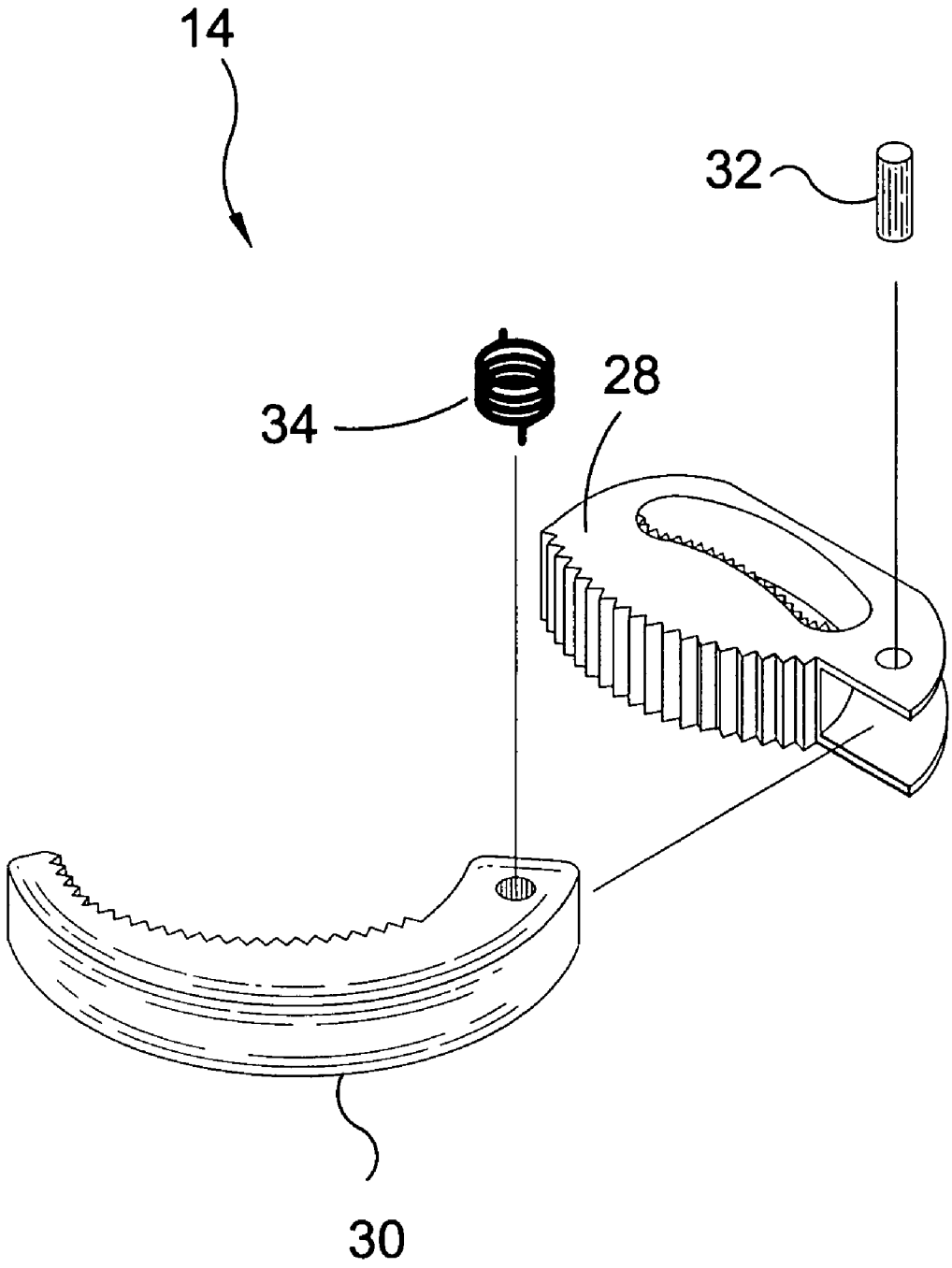
FIG. 4 is an exploded perspective view of the upper ratcheting jaw assembly.

FIG. 4 is an exploded perspective view of the ratcheting jaw assembly 14. The base jaw 28 and clamping jaw 30 are pivotally connected with a hinge pin 32 and a tension spring 34.

Figure 5:
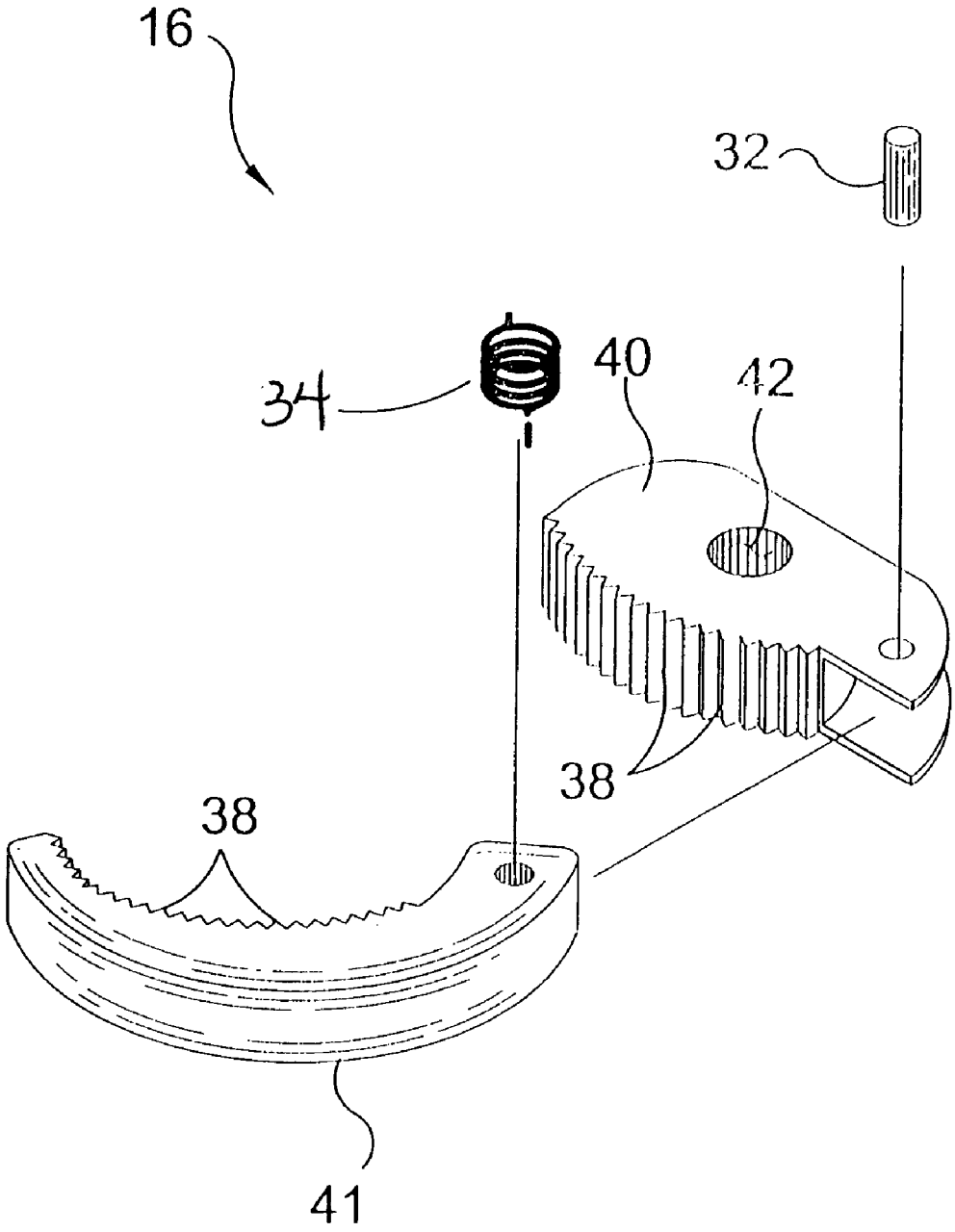
FIG. 5 is an exploded perspective view of the lower stationary jaw assembly.

FIG. 5 is an exploded view of the stationary jaw assembly 16. The stationary jaw assembly 16 of the present invention constrains the tool to the compression fitting coupling and is basically the same as the ratcheting jaw assembly. The serrated surfaces 38 of the jaw elements are parallel to each other when constrained by a hinge pin 32 inserted into a bore in each element. The tension spring 34 is located concentrically around the pin 32 and axially to both jaw members.

Figure 6:
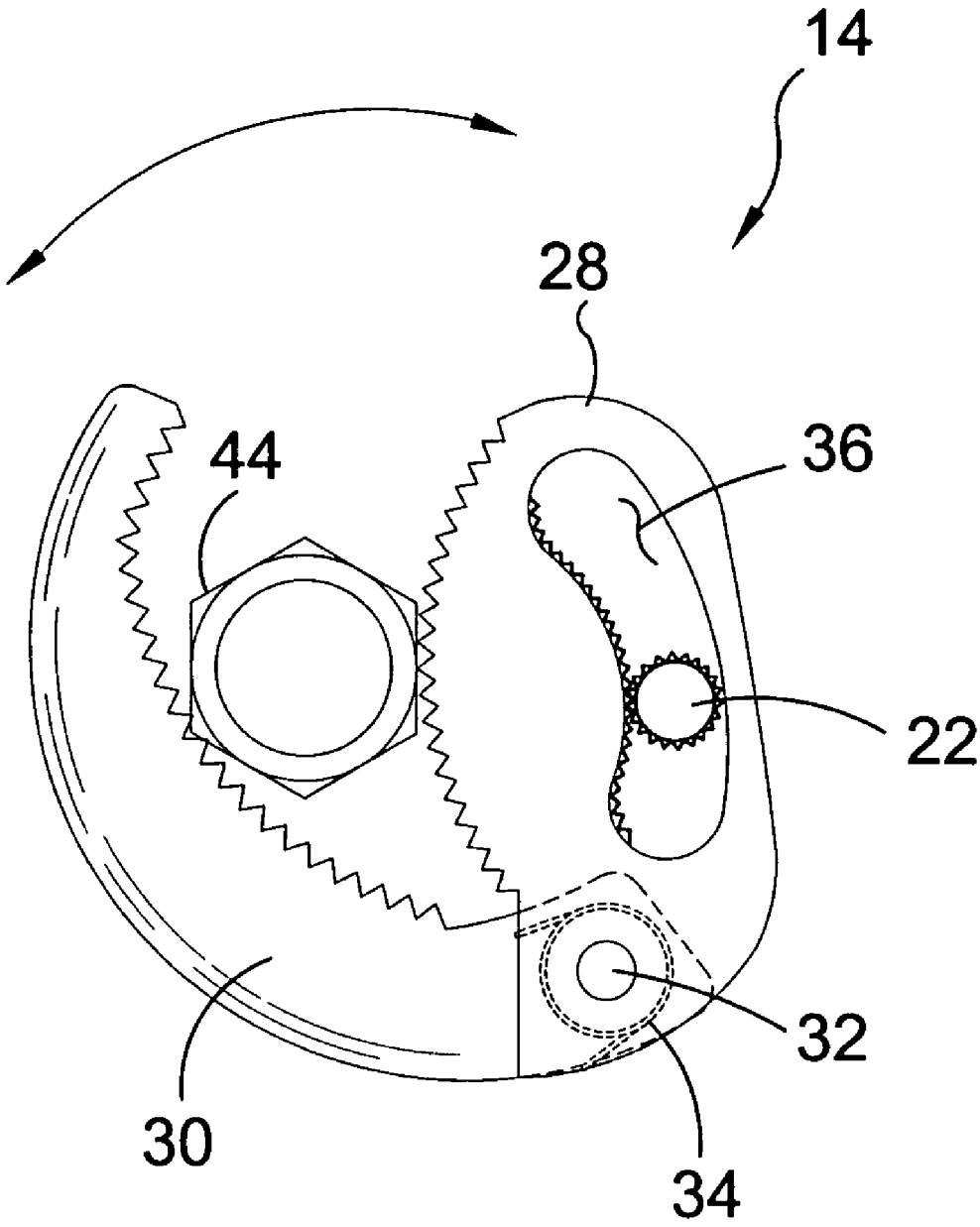
FIG. 6 is a top view of the upper ratcheting jaw assembly.

FIG. 6 is a plan view of the ratcheting jaw assembly 14. The ratcheting jaw assembly 14 is attached to the nut of the compression fitting by the same method as the stationary jaw assembly. Serrated jaws 38 initially compressed by the spring 34 in the assembly followed by the force transmitted by rotating the ratchet drive 22 in the internal ratchet drive input slot 36. This assembly rotates the nut 44 to either loosen or tighten the nut 44 connected to the compression-fitting coupling. This assembly also provides adjustment for any size compression fitting coupling.

Figure 7:
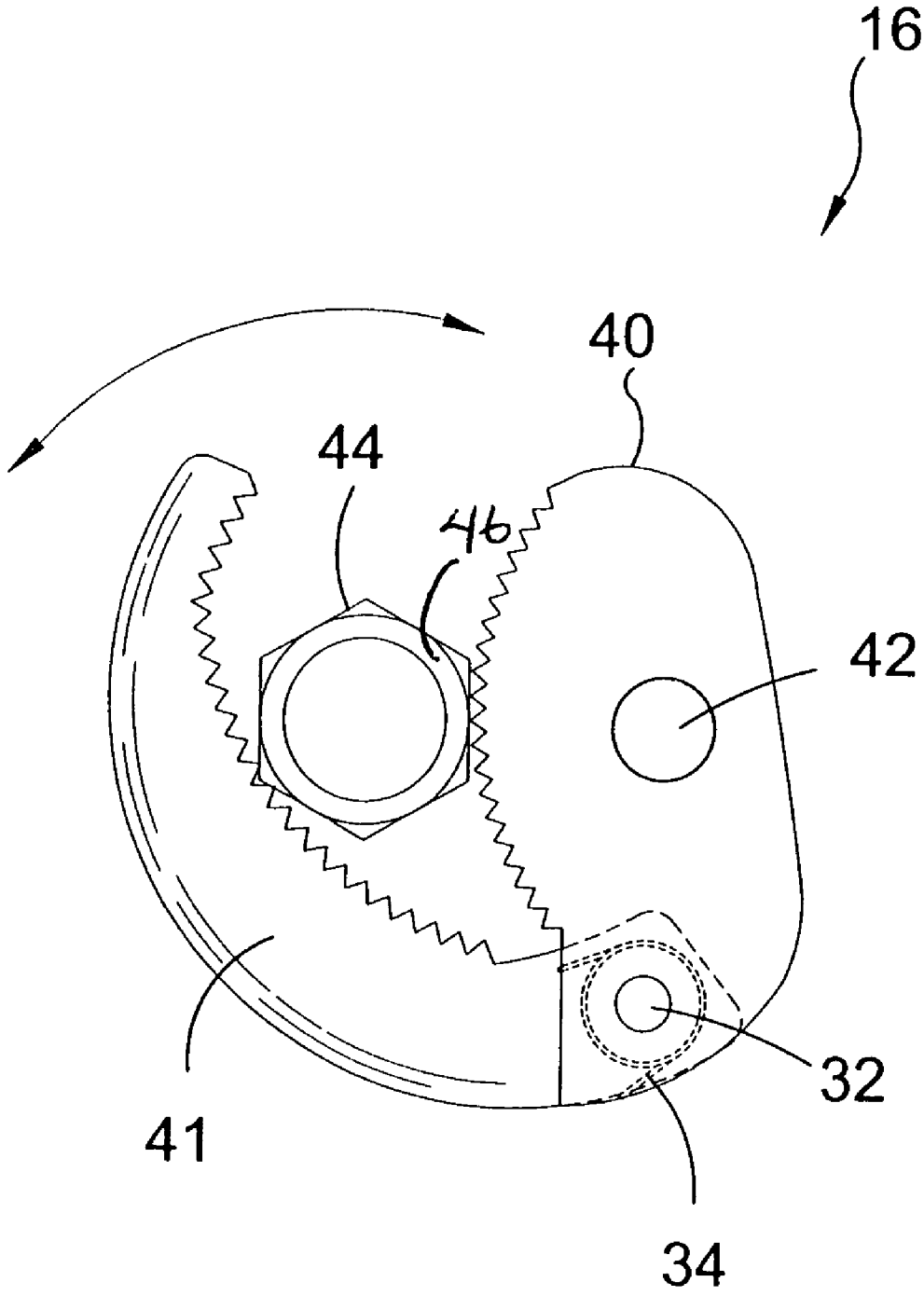
FIG. 7 is a top view of the bottom stationary jaw assembly.

FIG. 7 is a plan view of the stationary jaw assembly 16. The stationary jaw assembly 16 is attached to the compression fitting coupling 46. The base jaw 40 and the clamping jaw 41 are urged toward one another by the tension spring 34 surrounding the hinge pin 32.

Figure 8:
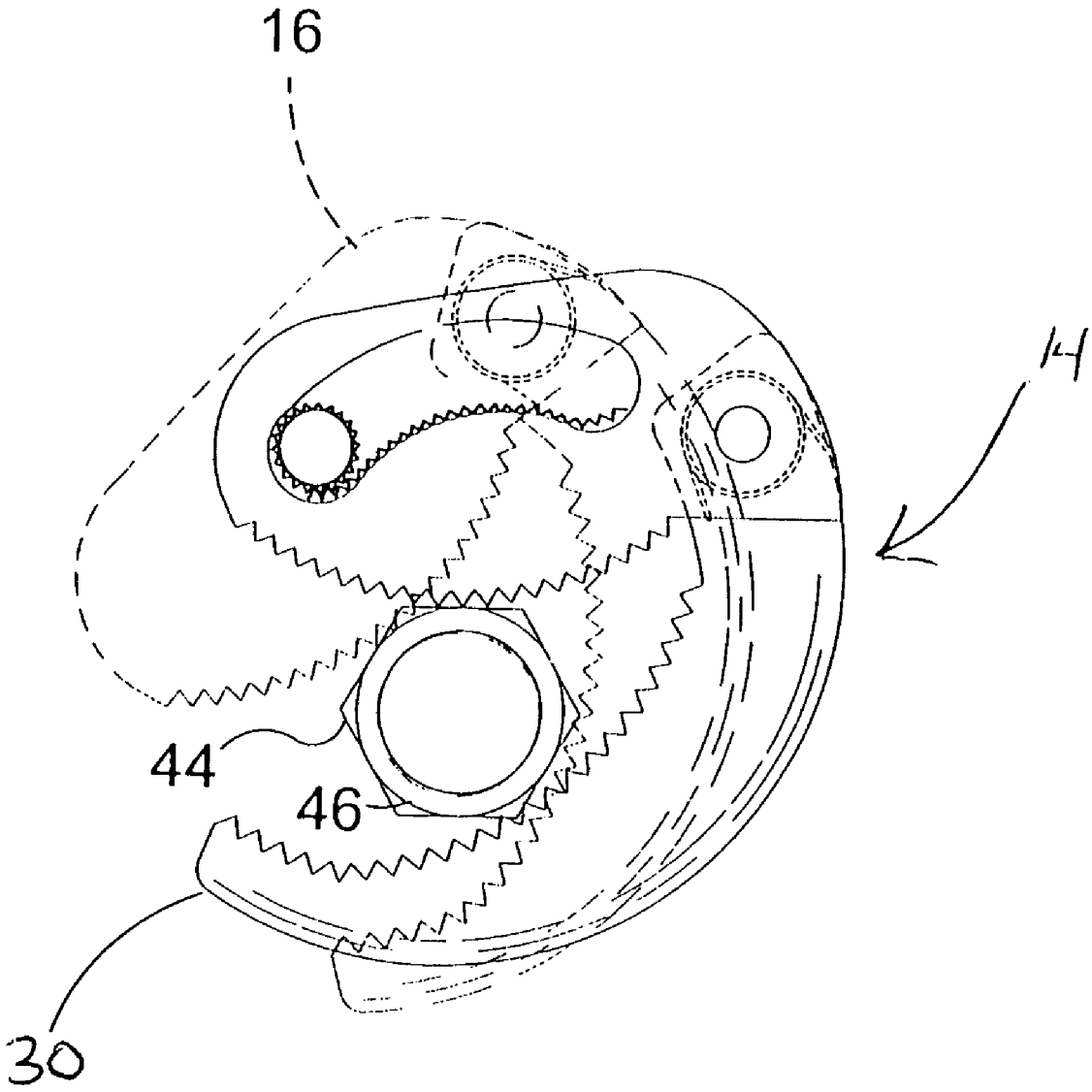
FIG. 8 is top view illustrating the cooperation between the upper ratcheting assembly and the stationary jaw assembly.

FIG. 8 is a top view of the present invention 10 in use. Shown are the ratcheting jaw assembly 14 and the stationary jaw assembly 16 and their displacement as the ratcheting jaw assembly 14 rotates the nut 44 while the stationary jaw assembly 16 assures that the coupling 46 remains fixed.

Figure 9:
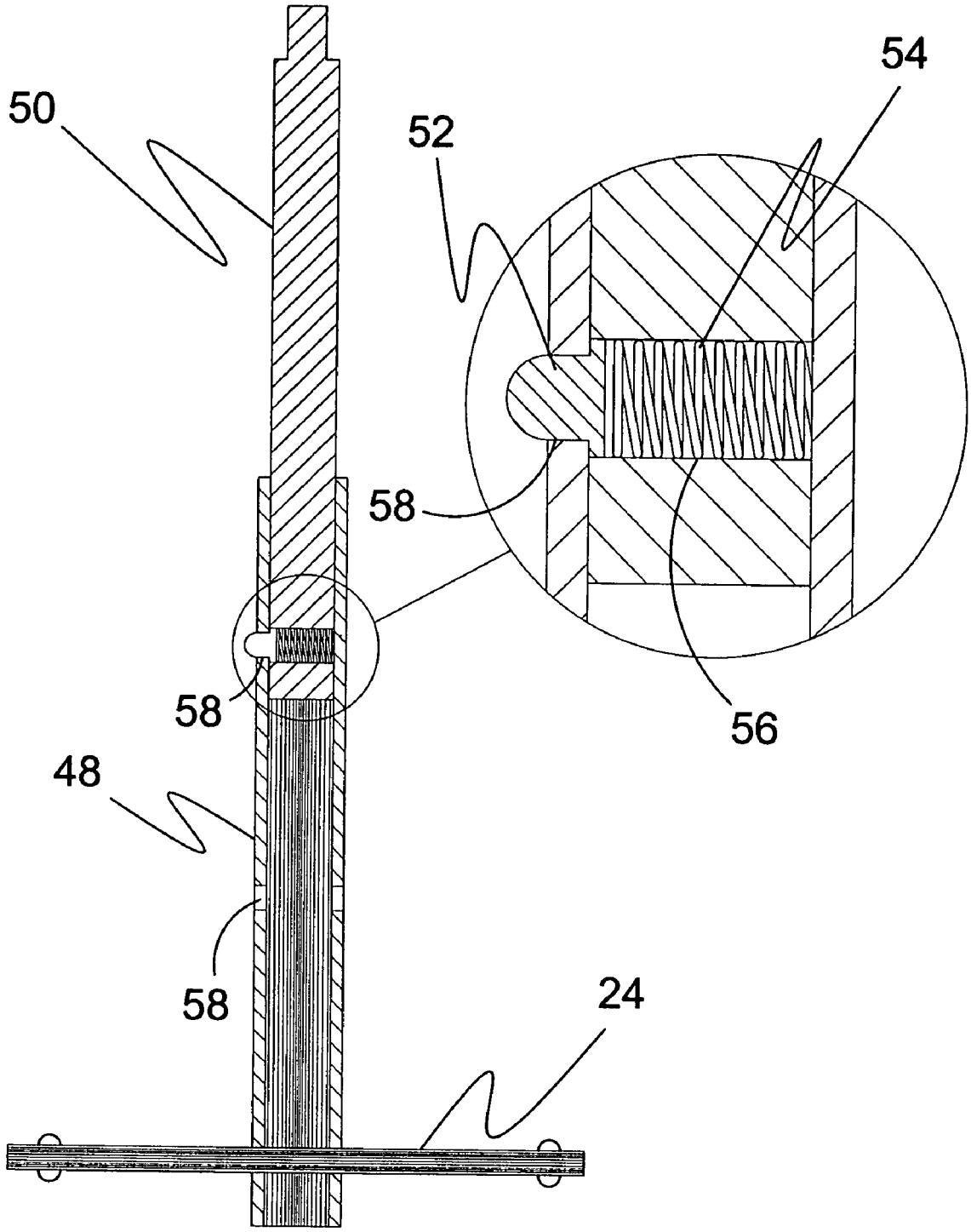
FIG. 9 is a cross sectional side view of the extendable spline handle assembly.

FIG. 9 is a cross-sectional view of the extendable spline handle assembly. The extendable spline shaft 50 can be located at multiple elevations in the handle barrel 48. A spring 54 and detent 52 located in a throughbore 56 of the spline shaft 50 lock the shaft in spaced apart throughbores 58 londitudinally located in a side wall of the barrel handle 48.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A dual-headed ratcheting basin wrench comprising:

a) an elongate handle having a superior first end and an inferior second end;

b) a ratchet assembly integral with said first end of said handle and including a geared ratchet drive extending therefrom;

c) a lower stationary jaw assembly comprising:

i) a base jaw having a convex side with a plurality of serrations disposed thereon and a circular ratchet drive input aperture for receiving said ratchet drive;

ii) an arcuate clamping jaw having a plurality of serrations disposed on the interior portion thereof;

iii) means for pivotally attaching said clamping jaw to said base jaw wherein said serrations of said clamping jaw are oriented towards said serrations of said base jaw; and iv) biasing means for urging said clamping jaw towards said base jaw;

d) an upper ratcheting jaw assembly comprising:

i) a base jaw having a convex side with a plurality of serrations disposed thereon and an arcuate ratchet drive input groove with a plurality of interiorly disposed serrations for receiving said ratchet drive;

ii) an arcuate clamping jaw having a plurality of serrations disposed on the interior portion thereof;

iii) a hinge pin for pivotally attaching said clamping jaw to said base jaw wherein said serrations of said clamping jaw are oriented towards said serrations of said base jaw; and iv) means for presenting a bias urging said clamping jaw towards said base jaw; and e) grasping means disposed on said second end of said handle to provide leverage for the user to rotate said handle.

2. A dual-headed ratcheting basin wrench as recited in claim 1, wherein said bias means for urging said clamping jaw towards said base jaw is a spring.

3. A dual-headed ratcheting basin wrench as recited in claim 2, wherein said handle includes a telescoping means for selectively extending and retracting said handle.

4. A dual-headed ratcheting basin wrench as recited in claim 3, wherein said telescoping means of said handle comprises:

a) a handle barrel forming said second end of said handle having a substantially hollow interior;

b) a spline shaft forming said first end of said handle conforming substantially to said hollow interior of said handle barrel within tolerances to allow said spline shaft to move freely therethrough with minimal play between sidewalls; and c) means to selectively secure said spline shaft within said handle barrel to provide a desired handle length for the task at hand.

5. A dual-headed ratcheting basin wrench as recited in claim 4, wherein said wherein said spline shaft securing means comprises:

a) a plurality of longitudinally disposed spaced apart recesses extending through a sidewall of said handle barrel; and b) a spring-loaded detent disposed within a recess of said spine shaft positioned to align with said handle barrel recesses as said spline shaft travels therethrough whereupon alignment with each said handle barrel recess results in said detent being urged therein by said detent spring thereby securing said spline shaft in that position until said detent is retracted by the user as said spline shaft is moved therethrough where it may travel freely until said detent aligns with another said handle barrel recess.

6. A dual-headed ratcheting basin wrench as recited in claim 1, wherein said lower stationary jaw assembly and said upper ratcheting jaw assembly are disposed on a distal end of said ratchet drive.

7. A dual-headed ratcheting basin wrench as recited in claim 6, wherein said ratchet drive extends through said ratchet drive input aperture of said stationary jaw assembly and said ratchet drive input groove of said upper ratcheting jaw assembly.

8. A dual-headed ratcheting basin wrench as recited in claim 7, wherein said stationary jaw assembly rotates freely around said ratchet drive.

9. A dual-headed ratcheting basin wrench as recited in claim 8, wherein the rotation of the handle by the user drives axial rotation of said ratchet drive which acts upon said inner serrations of said ratchet drive input groove of said upper ratcheting jaw assembly to rotate said upper ratcheting jaw assembly while said stationary jaw assembly remains static.

* * * * *